US008005248B1

(12) United States Patent
Davant

(10) Patent No.: US 8,005,248 B1
(45) Date of Patent: Aug. 23, 2011

(54) HEARING AID DEVICE WITH OUT-OF-EAR INDICATOR

(76) Inventor: Taylor B. Davant, Columbia, SC (US)

( * ) Notice: Subject to any disclaimer, the term of this patent is extended or adjusted under 35 U.S.C. 154(b) by 799 days.

(21) Appl. No.: 12/082,934

(22) Filed: Apr. 15, 2008

Related U.S. Application Data

(60) Provisional application No. 60/925,001, filed on Apr. 18, 2007.

(51) Int. Cl.
*H04R 25/00* (2006.01)

(52) U.S. Cl. ..... 381/324; 381/326; 381/328

(58) Field of Classification Search ..... None
See application file for complete search history.

(56) References Cited

U.S. PATENT DOCUMENTS 6,447,294 B1 9/2002 Price
6,532,294 B1 3/2003 Rudell
6,734,795 B2 5/2004 Price
2005/0226446 A1 10/2005 Luo et al.
2006/0078846 A1 4/2006 Ferri et al.
2006/0245611 A1 11/2006 Jørgensen et al.
2006/0251280 A1 * 11/2006 Fennell et al. ..... 381/328
2006/0256987 A1 * 11/2006 Beilin ..... 381/312

FOREIGN PATENT DOCUMENTS

WO WO2004110098 A1 * 12/2004

* cited by examiner

*Primary Examiner* — Hoang-Quan Ho
(74) *Attorney, Agent, or Firm* — Nelson Mullins Riley & Scarborough, LLP

(57) ABSTRACT

An improved hearing aid device having a perceivable indicator such that when the wearer removes the device from the ear canal, the indicator is activated. The indicator permits the user to easily locate the hearing aid device when it is needed again. The indicator may be a light emitting diode (LED) which illuminates continuously or it may blink to make it even more conspicuous. When the hearing aid is placed back in the user's ear, the indicator will be deactivated.

7 Claims, 2 Drawing Sheets

HEARING AID DEVICE WITH OUT-OF-EAR INDICATOR

PRIORITY CLAIM

This application claims the benefit of provisional application Ser. No. 60/925,001, filed Apr. 18, 2007, which is relied upon and incorporated herein by reference in its entirety.

BACKGROUND OF THE INVENTION

The present invention relates generally to the art of hearing aids. More particularly, the present invention relates to a hearing aid device that includes a conspicuous indicator when removed from the ear.

Hearing aids are inserted into the ear canal of a user to enhance ambient sound in an effort to compensate for hearing loss. It is desirable for hearing aids to be very small so that they are less noticeable when worn. When removed from the ear, however, the small size of a hearing aid can be a disadvantage.

In particular, a small hearing aid may be easily misplaced by a user. Or, the hearing aid may roll from a countertop and fall on the floor of the user's home. In this case, the user may inadvertently step on and destroy the hearing aid.

Because they are often tuned for the specific deficiencies in an individual's hearing, modern hearing aids can be relatively expensive. Particularly with elderly individuals living on a fixed income, the inadvertent loss of a hearing aid can be a very traumatic event. In addition, the user in such an event is deprived of the benefits of the hearing aid until it can be replaced.

SUMMARY OF THE INVENTION

The present invention provides an improved hearing aid device having a perceivable indicator such that when the wearer removes the device from the ear canal, the indicator is activated. The indicator permits the user to easily locate the hearing aid device when it is needed again.

For example, the indicator may be a light emitting diode (LED) triggered by a sensor on the device. When the device is removed from the ear, the sensor is activated, causing the LED to illuminate so it is clearly visible. The LED may illuminate continuously or it may blink to make it even more conspicuous. When the hearing aid is placed back in the user's ear, the indicator will be deactivated.

The sensor may be an ambient light sensor which detects a higher level of ambient light when the hearing aid is removed from the user's ear canal. In an alternative embodiment, a switch may be provided which opens when the device is placed in the user's ear canal, but closes when it is removed. For example, the switch may take the form of a button which is automatically pressed when the device is inserted into the user's ear canal. In either case, the device is designed so that the indicator is deactivated when placed back in the user's ear.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
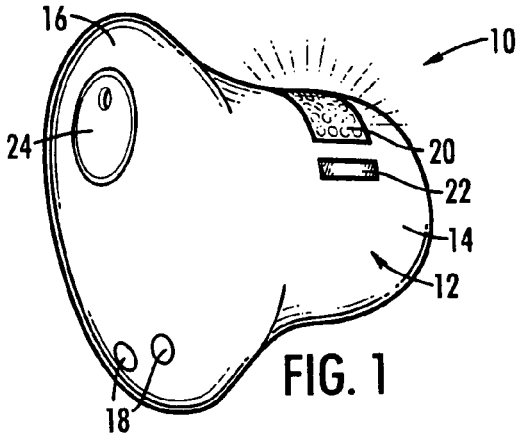
FIG. 1 is a perspective view of an exemplary hearing aid device constructed in accordance with a first embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

A variety of different configurations for hearing aid devices have been proposed over the years. For example, various hearing aid devices are shown in U.S. Published Application No. 2006/0245611 to Jorgensen, U.S. Published Application No. 2005/0226446 to Luo, and U.S. Pat. No. 6,532,294 to Rudell. Each of the foregoing documents is incorporated herein by reference in its entirety.

FIG. 1 illustrates a first embodiment of a hearing aid device 10 constructed in accordance with the present invention. Device 10 includes a housing 12 in which various electronics and other components are contained. Housing 12 is generally formed from a rigid plastic material that may be colored to approximate the user's skin tone. Housing 12 includes a narrow portion 14 intended for insertion in the user's ear canal. A wider portion 16 serves as a flange to inhibit insertion deeper into the ear canal than desired.

Device 10 includes an audio transmitting transducer (i.e., a small speaker) located adjacent an aperture in the tip of narrow portion 14. This transducer provides the amplified and/or conditioned sound directly to the user's ear canal. Similarly, an audio receiving transducer (i.e., a microphone) is located in wider portion 16 to receive sound from the ambient environment. In this embodiment, a pair of apertures 18 allow the ambient sound to pass through housing 14 to the receiving transducer.

Device 10 further includes an indicator 20 which is activated in a perceivable manner when narrow portion 14 is removed from the user's ear canal. In this case, indicator 20 includes one or more light emitting diodes (LEDs) that illuminate when activated. For example, the LEDs may blink at a predetermined frequency that is known to enhance perceptibility. As a result, device 10 will be more conspicuous and more easily located by the user.

In this embodiment, an ambient light sensor 22, such as a suitable photovoltaic cell, is located adjacent indicator 20 on narrow portion 14. When the device is removed from the user's ear canal, the level of light detected by sensor 22 increases. Because the increase in ambient light correlates with removal of device 10, indicator 20 will be automatically activated. Similarly, when narrow portion 14 is reinserted into the user's ear canal, the level of ambient light detected by sensor 22 will drop. As a result, indicator 20 will be deactivated. A battery cap 24 is provided to allow the replacement of the batteries of device 10 when necessary.

Figure 2:
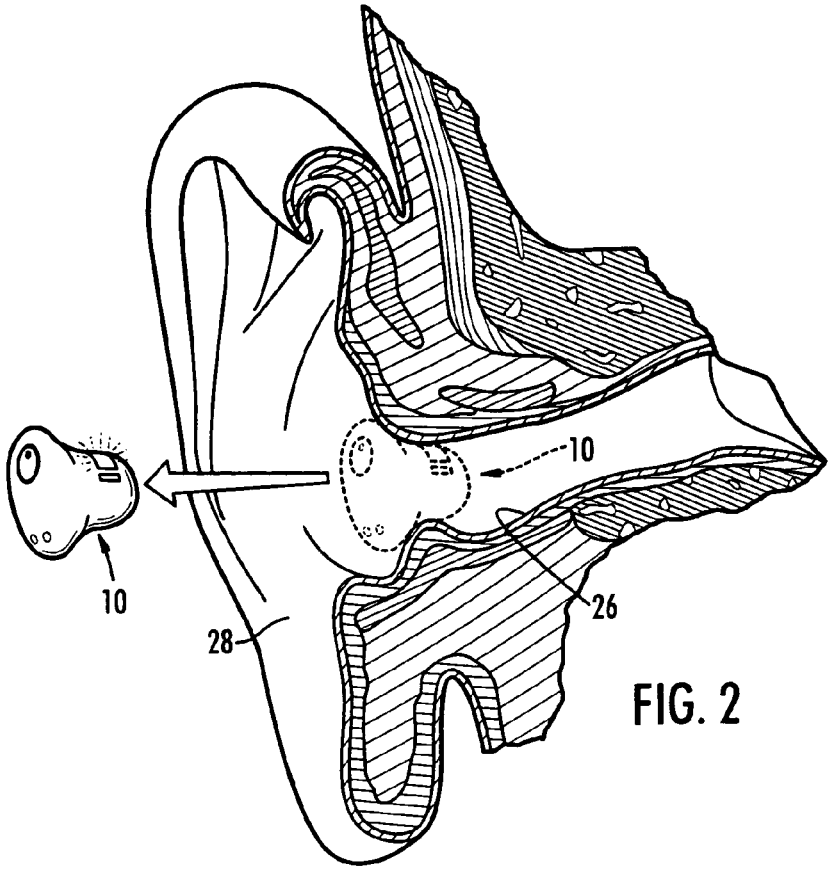
FIG. 2 shows insertion and removal of the hearing aid device of FIG. 1 in relation to a user's ear canal.

FIG. 2 shows the relative position of device 10 when inserted (in phantom lines) and removed (in solid lines) from the canal 26 of a user's ear 28.

Figure 3:
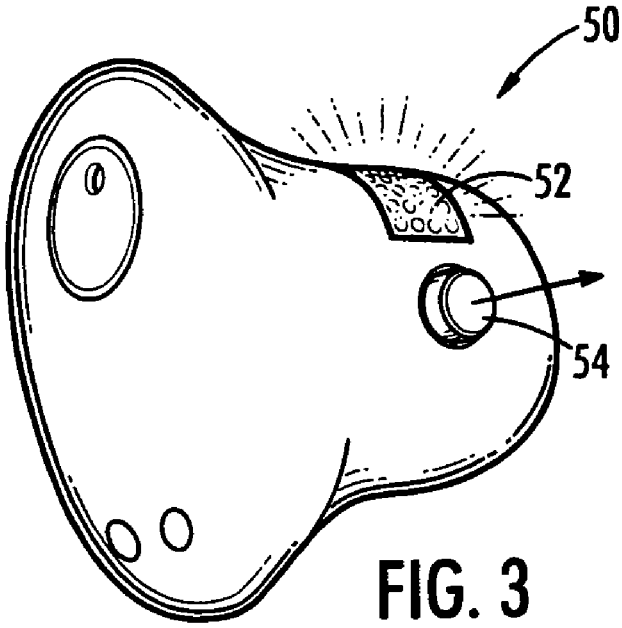
FIGS. 3 and 4 are perspective views of a hearing aid device in accordance with a second embodiment of the present invention showing the indicator activation switch in closed and open positions, respectively.
Figure 4:
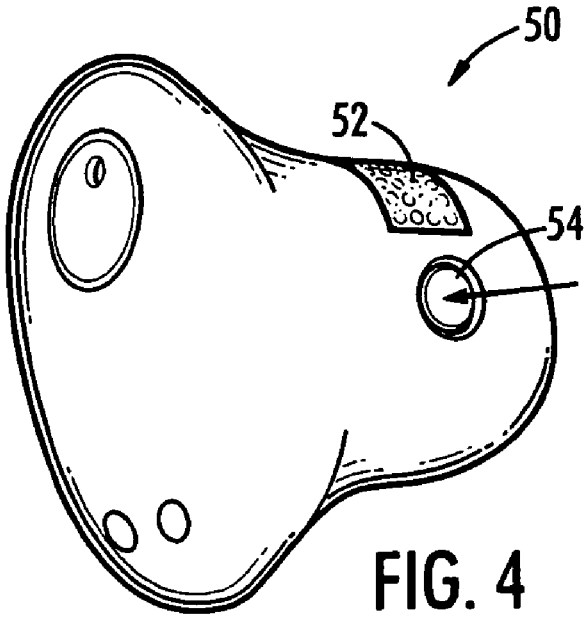

FIGS. 3 and 4 illustrate a hearing aid device 50 constructed pursuant to an alternative embodiment of the present invention. It will be appreciated that many of the components and general housing configuration of device 50 may be the same as or similar to device 10. In this case, however, indicator 52 is activated and deactivated by a mechanical switch in the form of a button 54. Preferably, button 54 may be spring-biased such that it will move outward when device 50 is removed from the user's ear canal. Movement of button 54 in this outward direction will close the switch, thus activating indicator 52 as shown in FIG. 3.

When device 50 is inserted into the user's ear canal, however, the gentle spring force of button 54 is overcome. As a result, button 54 will be pushed into a position flush with the housing's outer surface, thus opening the corresponding switch. Indicator 52 will thus be deactivated as shown in FIG. 4.

It can thus be seen that the present invention provides an improved hearing aid device in which a conspicuous indicator is activated upon removal from the user's ear canal. As a result, the device is more easily locatable with less chance for loss or destruction.

While preferred embodiments of the invention have been shown and described, modifications and variations may be made thereto by those of ordinary skill in the art without departing from the spirit and scope of the present invention. For example, the indicator is shown in the illustrated embodiments located on the narrow portion of the housing. It will be appreciated, however, that the indicator may be located on any part of the housing from which it can be seen when the device is removed from the user's ear canal. In addition, it should be understood that aspects of the various embodiments may be interchanged, both in whole or in part. Furthermore, those of ordinary skill in the art will appreciate that the foregoing description is by way of example only, and is not intended to be limitative of the invention.

What is claimed is:

1. A hearing aid device comprising:

a housing having an insertion portion adapted to be inserted into a user's ear canal;

a perceivable indicator conspicuous when said insertion portion is removed from the user's ear canal; and means for activating said perceivable indicator when said insertion portion is removed from the user's ear canal, wherein said means for activating comprises an ambient light sensor located at said insertion portion of said housing, whereby the user can easily locate the hearing aid device when it is needed again.

2. A hearing aid device as set forth in claim 1, wherein said perceivable indicator comprises a light emitting diode (LED).

3. A hearing aid device comprising:

a housing having an insertion portion adapted to be inserted into a user's ear canal;

an electrically activated perceivable indicator conspicuous when said insertion portion is removed from the user's ear canal; and means for automatically activating said perceivable indicator in response to removal of said insertion portion from the user's ear canal, whereby the user can easily locate the hearing aid device when it is needed again.

4. A hearing aid device as set forth in claim 3, wherein said means for activating comprises a spring-biased switch which is open when said insertion portion of said housing is inserted in the user's ear canal.

5. A hearing aid device as set forth in claim 3, wherein said perceivable indicator comprises a light emitting diode (LED) triggered by a sensor on the device.

6. A hearing aid device as set forth in claim 5, wherein said LED illuminates continuously when said insertion portion is removed from the user's ear canal.

7. A hearing aid device as set forth in claim 5, wherein said LED blinks when said insertion portion is removed from the user's ear canal.

* * * * *